United States Patent [19]

Bottalico et al.

[11] 4,178,494

[45] Dec. 11, 1979

[54] MICRO-WAVE AIR HEATER

[76] Inventors: Frank P. Bottalico; Frank P. Bottalico, Jr., both of 9803 Healy Ct., Upper Marlboro, Md. 20870

[21] Appl. No.: 850,351

[22] Filed: Nov. 10, 1977

[51] Int. Cl.[2] ..... H05B 9/06

[52] U.S. Cl. ..... 219/10.55 R; 219/10.55 A; 219/341

[58] Field of Search ..... 219/10.55 R, 10.55 A, 219/10.55 M, 10.55 F, 10.55 E, 341, 365; 126/378, 377; 165/59, 48

[56] References Cited

U.S. PATENT DOCUMENTS

| | | | |
|---|---|---|---|
| 2,585,970 | 2/1952 | Shaw | 219/10.55 R X |
| 3,778,578 | 12/1973 | Long | 219/10.55 R |
| 3,891,817 | 6/1975 | Brown | 219/10.55 R |
| 3,920,945 | 11/1975 | Smith et al. | 219/10.55 A |
| 4,006,730 | 2/1977 | Clapham et al. | 219/10.55 R |
| 4,029,927 | 6/1977 | McMillan | 219/10.55 A |
| 4,114,011 | 9/1978 | Stubbs | 219/10.55 M |

*Primary Examiner*—Arthur T. Grimley
*Attorney, Agent, or Firm*—Diller, Ramik & Wight

[57] ABSTRACT

This disclosure relates to a micro-wave air heater which includes a generally upstanding frusto-conical air duct housing between opposite input and output end portions thereof, crossed tubular liquid conduits which open into an encirculating liquid chamber, and a plurality of micro-wave generating means externally of the liquid chamber for generating micro-wave energy for heating the liquid whereby air passing through the duct and passed the tubular conduits is heated. The liquid is self-circulating within the tubular conduits and the liquid chamber through liquid temperature gradients, and means are provided for selectively regulating the operation of the micro-wave generating means to create the liquid temperature gradients.

12 Claims, 2 Drawing Figures

10
11
35
26
27
16
40
32
41
18
33'
34
25
17
13
14
15
12
30
31
33
24
22
23
20
21
44
42
43
T
D
V1
2

10
40
18
14

MICRO-WAVE AIR HEATER

A primary object of this invention is to provide a novel micro-wave air heater including a hollow air duct through which air is adapted to pass from an input end portion toward and through an output end portion thereof, a plurality of tubular conduits spanning the duct within an interior thereof between the input and output end portions, wall means externally of and in generally spaced relationship to the duct and defining therewith a liquid chamber, a liquid in the tubular conduits and a liquid chamber, and micro-wave generating means exteriorly of the liquid chamber for generating micro-wave energy for heating the liquid whereby air passing through the duct and passed the tubular conduits is heated.

A further object of this invention is to provide a novel micro-wave air heater of the type described wherein the micro-wave generating means or a plurality of micro-wave generators surround the wall means, the air duct is disposed generally vertically and is of a generally frusto-conical configuration as viewed in longitudinal cross-section with the input end portion being of a smaller cross sectional area than the output end portion and being located thereabove.

Still another object of this invention is to provide a novel micro-wave air heater of the type described wherein the wall means, duct, and tubular conduits are made of material transparent to micro-wave energy.

A further object of this invention is to provide a novel micro-wave air heater as aforesaid wherein the liquid is self-circulating within the tubular conduits and the liquid chamber through liquid temperature gradients of the liquid.

Yet another object of this invention is to provide a novel micro-wave air heater as set forth heretofore including pump means for circulating the liquid through the tubular conduits and the liquid chamber thereby augmenting the self-circulation of the liquid, means to selectively regulate the operation of the micro-wave generating means to create the liquid temperature gradients, and air temperature detecting means for operating the micro-wave generators.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
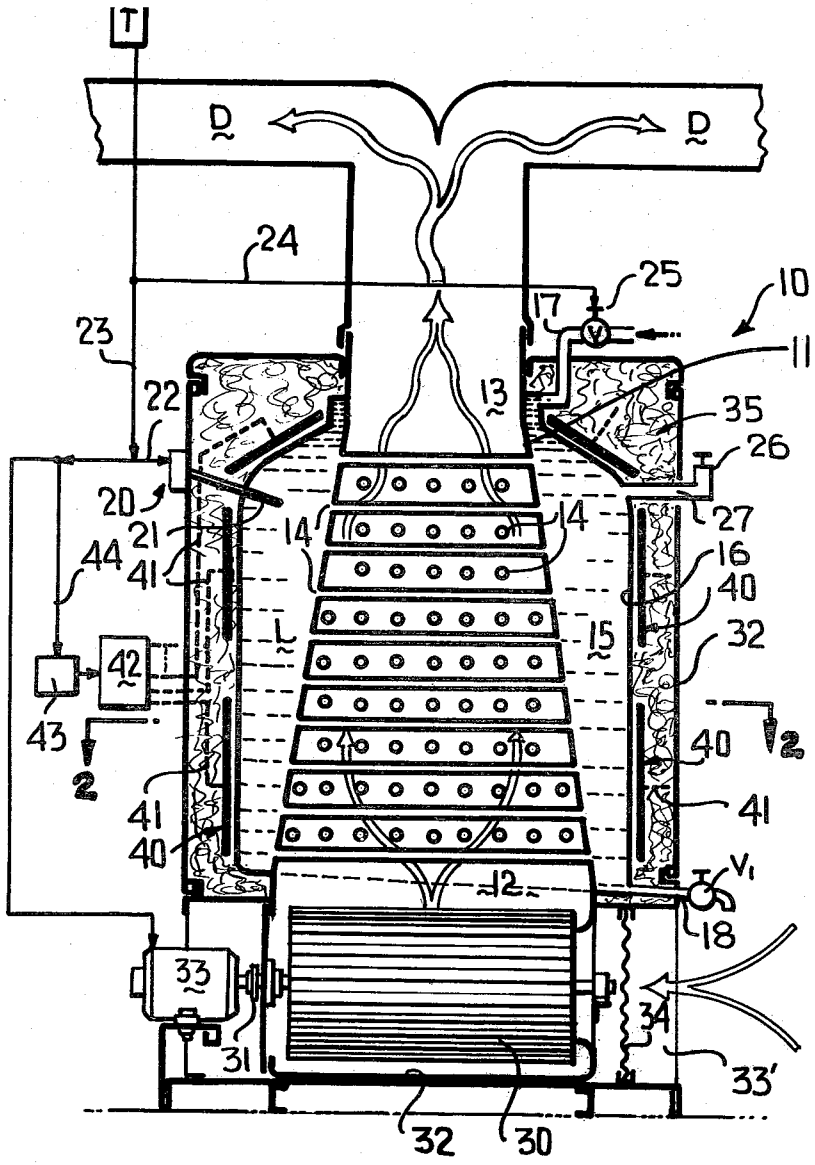
FIG. 1 is a vertical sectional view of a novel micro-wave air heater constructed in accordance with this invention and illustrates a generally vertically disposed air duct crossed by tubular conduits opening into a liquid chamber housing a liquid which is heated by micro-wave energy generated by micro-wave generators exteriorly of the liquid chamber.
Figure 2:
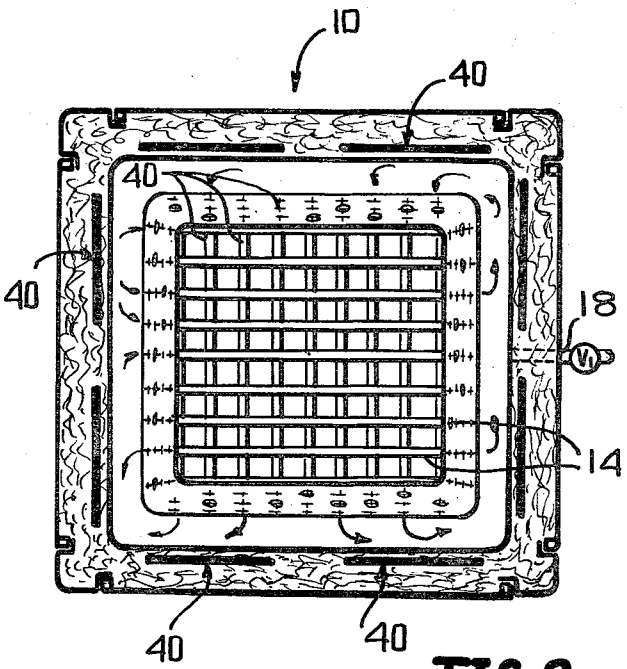
FIG. 2 is a sectional view taken generally along line 2—2 of FIG. 1, and illustrates in more detail the duct, the tubular conduits, and the micro-wave generators in generally surrounding relationship to a wall defining an exterior of the liquid chamber.

A novel micro-wave air heater constructed in accordance with this invention is generally designated by the reference numeral 10 (FIGS. 1 and 2) and includes a hollw and generally vertically disposed air duct 11 of a frusto-conical cross sectional configuration as viewed in longitudinal or axial cross-section, and having a lower input end portion 12 and an output end portion 13. The upper output end portion 13 is of a smaller transverse cross-sectional area than that of the lower input end portion 12, as is readily apparent from FIGS. 1 and 2 of the drawings. A plurality of tubular conduits 14 are positioned within the air duct 11 between the input and output end portions 12, 13, respectively, and each of the tubular conduits 14 has opposite open ends (unnumbered) which open into a liquid chamber 15 housing a liquid L, such as water. The liquid chamber 15 is defined generally by an exterior wall (unnumbered) of the duct 11 and wall means 16 in generally spaced exterior surrounding relationship to the duct 11.

The liquid or water is introduced to an upper end portion (unnumbered) of the liquid chamber through a suitable tubular conduit or pipe 17 regulated by a valve V which is supplied from a suitable source (not shown) as, for example, a city, county, or like water supply. A tubular conduit or pipe 18 is provided at a lower end portion (unnumbered) of the liquid chamber for draining off the liquid L by means of a conventional manual valve V-1.

Means generally designated by the reference numeral 20 is provided for detecting the level of liquid L within the liquid chamber 15 by means of a conventional detecting probe 21. The means 20 is coupled through conventional circuitry or wiring 22 through 24 to a conventional electrical servomechanism 25 for opening and/or closing a valve V in an automatic fashion to maintain a predetermined level of liquid L within the liquid chamber 15.

The liquid chamber 15 is also placed in fluid communication with a pressure responsive relief valve 26 by means of a conduit or pipe 27 to assure that neither the duct 11 nor the wall means 16 will be damaged due to excessive internal pressure upon the heating of the liquid in the manner to be described hereinafter.

Air is blown through the duct 11 from the input end portion 12 to and through the output end portion 13 by means of a conventional fan 30 having a shaft 31 journaled for rotation in a frame 32 and driven by a conventional electrical motor 33. The motor 33 is, of course, energized from a suitable electrical source (not shown) and the frame or housing 32 includes a suitable opening 33' housing a filter 34 through which the air is drawn by the fan 30 for subsequent passage into and through the duct 11 in the manner indicated by the unnumbered headed arrows. During the passage of the air through the duct 11, the air is heated by convection due to the hot liquid surrounding the duct 11 and within the tubular conduits 14, again as will be described more fully hereinafter. The thus heated air is then distributed through suitable duct work D for subsequent utilization.

A portion of the frame or housing 32 is in spaced relationship to the wall means 16 and disposed within this spacing (unnumbered) is suitable insulation (thermal) 35 and micro-wave generating means in the form of a plurality of micro-wave generators 40 which are in generally surrounding relationship (FIG. 2) of the liquid chamber 15 and the duct 11. The micro-wave generators 40 are of the conventional construction and may be, for example, the type disclosed in U.S. Pat. No. 3,812,315 in the name of Norman E. Martin, issued May 21, 1974. If in the form of such separate sets of capacitive plates, the same are connected through conventional wiring 41 to a conventional switching unit 42 which is in turn connected to a solenoid operated stepping switch 43 which is in trun electrically connected to a thermostat T through the conductor 23, a portion of the conductor 22, and a conductor 44. Depending upon the output of the thermostat T, the stepping switch 43 energizes the switching unit 42 to place a single pair, or two pair, or three pair, etc., of the micro-wave generating means into operation to increase the micro-wave energy generated. Likewise, the capacitive plates 40 which, again, are arranged in opposing pairs, may be selectively deenergized to reduce the amount of micro-wave energy. Thus, by this control, the liquid L can be more rapidly brought to a desired temperature when, for example, all of the micro-wave generators 40 are energized and when a desired temperature level is reached the same may be maintained at this temperature level by initially deenergizing all of the micro-wave generators 40 and then selectively energizing only certain pairs thereof to maintain the temperature of the liquid L at a desired level. Obviously, the higher the temperature of the liquid L within the liquid chamber 15, the greater will be the transfer of the heat to the air as it passes through the duct 11. Furthermore, the material from which the wall means 16, the duct 11, and the tubular conduits 14 is constructed is preferably transparent to the micro-wave energy to provide simultaneously heating of the liquid L by both direct dielectric heating and conductive heating as well as convection heating. Moreover, due to the selective energization of the micro-wave generators 40, the liquid L is self-circulating through the chamber 15 and the tubular conduits 11 through temperature gradients. For example, by energizing the lowermost of the micro-wave generators 40 (FIG. 1), the liquid L adjacent the bottom end portion (unnumbered) of the liquid chamber 15 will be heated to a higher temperature of the liquid thereabove and the hotter liquid will rise causing circulation within the liquid chamber 15 and the tubular conduits 14. Of course, this liquid circulation through the temperature gradient of the liquid may be augmented by a suitable pump for circulating the liquid within the chamber 15 and the tubular conduits 14.

Although only a preferred embodiment of the invention has been specifically illustrated and described herein, it is to be understood that minor variations may be made [in the apparatus or in the method of] without departing from the spirit and scope of the invention, as defined in the appended claims.

I claim:

1. A micro-wave air heater comprising a hollow air duct through which air is adapted to pass from an input end portion toward and through an output end portion thereof, a plurality of tubular conduits spanning said duct within an interior thereof between said input and output end portions, micro-wave transparent wall means externally of and in generally spaced relationship to said duct and defining therewith a liquid chamber, a liquid in said tubular conduits and said liquid chamber, and micro-wave generating means exteriorly of said liquid chamber for generating micro-wave energy for heating said liquid whereby air passing through said duct and past said tubular conduits is heated.

2. The micro-wave air heater as defined in claim 1 wherein said micro-wave generating means are a plurality of micro-wave generators surrounding said wall means.

3. The micro-wave air heater as definced in claim 1 wherein said air duct is disposed generally vertically and is of a generally frusto-conical configuration as viewed in longitudinal cross-section.

4. The micro-wave air heater as defined in claim 1 wherein said duct, and conduits are made of material transparent to micro-wave energy.

5. The micro-wave air heater as defined in claim 1 wherein said tubular conduits are in alternating crossed relationship.

6. The micro-wave air heater as defined in claim 1 wherein said liquid is self-circulating within said tubular conduits and said liquid chamber through liquid temperature gradients of said liquid.

7. The micro-wave air heater as defined in claim 1 wherein said liquid is self-circulating within said tubular conduits and said liquid chamber through liquid temperature gradients of said liquid, and means to selectively regulate the operation of said micro-wave generating means to create said liquid temperature gradients.

8. The micro-wave air heater as defined in claim 1 wherein said liquid is self-circulating within said tubular conduits and said liquid chamber through liquid temperature gradients of said liquid, means to selectively regulate the operation of said micro-wave generating means to create said liquid temperature gradients, and pump means for circulating said liquid through said tubular conduits and said liquid chamber thereby augmenting the self-circulation of said liquid.

9. The micro-wave air heater as defined in claim 1 wherein said micro-wave generating means are a plurality of micro-wave generators surrounding said wall means, said air duct is disposed generally vertically and is of a generally frusto-conical configuration as viewed in longitudinal cross-section, said duct input end portion is below said duct output end portion and the latter being of a larger square area than the former, said duct, and conduits being made of material transparent to micro-wave energy, said tubular conduits being alternating crossed relationship, and said liquid being self-circulating within said tubular conduits and said liquid chamber through liquid temperature gradients of said liquid.

10. The micro-wave heater as defined in claim 9 including means for selectively regulating the operation of said micro-wave generators to create said liquid temperature gradients.

11. The micro-wave air heater as defined in claim 10 including air temperature detecting means for operating said micro-wave generator regulating means.

12. The micro-wave air heater as defined in claim 11 including means for sensing the level of liquid in said liquid chamber, and said micro-wave generator regulating means being deactivated to deactivate said micro-wave generators upon a predetermined liquid level within said liquid chamber being sensed by said level sensing means.

* * * * *